US008609001B2

(12) United States Patent
Pai et al.

(10) Patent No.: US 8,609,001 B2
(45) Date of Patent: Dec. 17, 2013

(54) METHOD OF MANUFACTURING POLISHING PAD HAVING DETECTION WINDOW

(75) Inventors: Kun-Che Pai, Taichung (TW); Shiuan-Tzung Li, Taichung (TW); Chao-Chin Wang, Taichung (TW); Wei-Wen Yang, Taipei (TW)

(73) Assignee: IV Technologies Co., Ltd., Taichung (TW)

( * ) Notice: Subject to any disclaimer, the term of this patent is extended or adjusted under 35 U.S.C. 154(b) by 581 days.

(21) Appl. No.: 12/795,966

(22) Filed: Jun. 8, 2010

(65) Prior Publication Data

US 2011/0159793 A1 Jun. 30, 2011

(30) Foreign Application Priority Data

Dec. 31, 2009 (TW) ..... 98146184 A

(51) Int. Cl.
*B29C 39/10* (2006.01)
*B29C 39/12* (2006.01)

(52) U.S. Cl.
USPC ..... 264/255; 264/267

(58) Field of Classification Search
None
See application file for complete search history.

(56) References Cited

U.S. PATENT DOCUMENTS

| | | | | |
|---|---|---|---|---|
| 6,752,690 | B1 * | 6/2004 | Fruitman | 451/6 |
| 7,871,309 | B2 * | 1/2011 | Ogawa et al. | 451/41 |
| 2004/0094855 | A1 | 5/2004 | Shih et al. | 264/46.4 |
| 2004/0203320 | A1 | 10/2004 | Hosaka et al. | |
| 2005/0275135 | A1 | 12/2005 | David et al. | 264/257 |
| 2006/0198992 | A1 | 9/2006 | Shih et al. | 428/174 |
| 2007/0042693 | A1 * | 2/2007 | Saikin | 451/527 |
| 2009/0181608 | A1 | 7/2009 | Li et al. | 451/526 |
| 2009/0253353 | A1 * | 10/2009 | Ogawa et al. | 451/41 |

FOREIGN PATENT DOCUMENTS

| | | | |
|---|---|---|---|
| EP | 1 466 699 | | 10/2004 |
| JP | 2007118106 | * | 5/2007 |
| TW | 200513344 | | 4/2005 |
| TW | 200628262 | | 8/2006 |

OTHER PUBLICATIONS

Taiwanese Office Action for corresponding TW Application No. 098146184, Jul. 13, 2011, pp. 1-10.
Hungarian Examination Report of Singapore Application No. 201004961-7, dated Mar. 9, 2011.

* cited by examiner

*Primary Examiner* — Edmund H. Lee
(74) *Attorney, Agent, or Firm* — Ditthavong Mori & Steiner, P.C.

(57) ABSTRACT

A polishing pad having a detection window and a method of manufacturing the polishing pad are provided. A dummy detection window is pre-disposed in a mold. A polishing layer precursor is filled into the mold, and then a solidifying process is performed to form a polishing layer, wherein the polishing layer and the dummy detection window are separable completely. The polishing layer and the dummy detection window are separated from each other so as to form a detection opening in the polishing layer. The detection opening can alternatively be formed in a mold having a protrusion structure to replace the dummy detection window. A detection window precursor is filled into the detection opening, and then a solidifying process is performed to form a detection window.

8 Claims, 18 Drawing Sheets

METHOD OF MANUFACTURING POLISHING PAD HAVING DETECTION WINDOW

BACKGROUND OF THE INVENTION

1. Field of the Invention

The invention generally relates to a polishing pad and a method of manufacturing the same, and more particularly to a polishing pad having a detection window and a method of manufacturing the same.

2. Description of Related Art

Along with advancement of the industries, planarization processes are often adopted as processes for manufacturing various devices. In planarization processes, polishing process is often used in the industries.

Generally, polishing process applies a pressure on an article to be polished so as to press the article onto a polishing pad, and provides a relative movement between the article and the polishing pad. Through mechanical friction generated by the relative movement, a portion of a surface layer on the article is removed, so that the surface is gradually planarized, thereby achieving the purpose of planarization. Optionally, polishing solution or polishing slurry containing chemical composition can be applied on the polishing pad during polishing process, such that the surface of the article is planarized under the synergy of mechanical effect and chemical effect.

For a polishing apparatus with an optical detection system, a transparent detection window is usually disposed on a region of the polishing pad. By detecting the polishing condition on the surface of the article through the transparent detection window with the optical detection system, user can determine an end-point detection of the polishing process.

In a conventional method of manufacturing a detection window on a polishing pad, a polishing pad is first manufactured and a detection opening is formed on the polishing pad by mechanical cutting. Thereafter, a detection window material is filled into the detection opening and a curing process is carried out for curing the detection window material to form a detection window. However, in this method, the detection opening is formed on the polishing pad by mechanical cutting, such that an additional cutting procedure is required and the time required for manufacturing the polishing pad is increased. As this method requires additional mechanical cutting tool, the manufacturing cost may also be higher.

In another conventional method of manufacturing a detection window on a polishing pad, the detection window is first formed and placed in a mold. Then, a polishing pad material is filled into the mold and then a curing process is performed, so that the polishing pad having the detection window is formed. Nevertheless, the bonding strength between the polishing pad and the detection window formed by this method is insufficient. In other words, using the polishing pad formed by the aforementioned method applying to a longer polishing time accumulated, liquid tends to penetrate through a boundary between the polishing pad and the detection window to the optical detection system. Consequently, the end-point detection of the polishing is interfered so as to affect the polishing quality of the article.

SUMMARY OF THE INVENTION

The invention is directed to a method of manufacturing a polishing pad having a detection window, where a mechanical cutting procedure is not required to form a detection opening.

The invention is directed to a polishing pad having a detection window, in which the detection window and the polishing pad have better bonding strength therebetween.

The invention is directed to a method of manufacturing a polishing pad having a detection window. A dummy detection window is pre-disposed in a mold. A polishing layer precursor is filled into the mold and a solidifying process is performed to form a polishing layer, wherein the dummy detection window and the polishing layer are separable completely. The dummy detection window and the polishing layer are separated to form a detection opening in the polishing layer. A detection window precursor is filled into the detection opening and a solidifying process is performed to form a detection window.

The invention is further directed to another method of manufacturing a polishing pad having a detection window. A mold having a protrusion structure is provided. A polishing layer precursor is filled into the mold and a solidifying process is performed to form a polishing layer, in which the protrusion structure defines a detection opening in the polishing layer. A detection window precursor is filled into the detection opening and a solidifying process is performed to form a detection window.

The invention is further directed to another method of manufacturing a polishing pad having a detection window. A polishing layer having a detection opening pre-formed therein is provided. A detection window is disposed in the detection opening, where a gap is between a peripheral surface of the detection window and an inner side surface of the detection opening. A buffer layer is filled into the gap.

The invention is directed to a polishing pad having a detection window, and the polishing pad includes a polishing layer, a detection window, and a buffer layer. The polishing layer has a detection opening. The detection window is disposed in the detection opening, where a gap is between a peripheral surface of the detection window and an inner side surface of the detection opening, and the gap is filled by the buffer layer.

The invention is further directed to a polishing pad having a detection window. The polishing pad includes a polishing layer and a detection window disposed in the polishing layer. In particular, the maximum tensile strength of elastic deformation between the detection window and the polishing layer is greater than 85 $kgf/cm^2$.

In light of the foregoing, the method of manufacturing the polishing pad does not require mechanical cutting tool to manufacture the detection opening. Thus, comparing with the conventional method, the method of the invention has the advantage of simpler procedure and/or lower manufacturing cost. Furthermore, comparing with the conventional method, the polishing pad of the invention has better bonding strength between the polishing layer and the detection window.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

First Embodiment

Figure 1A:
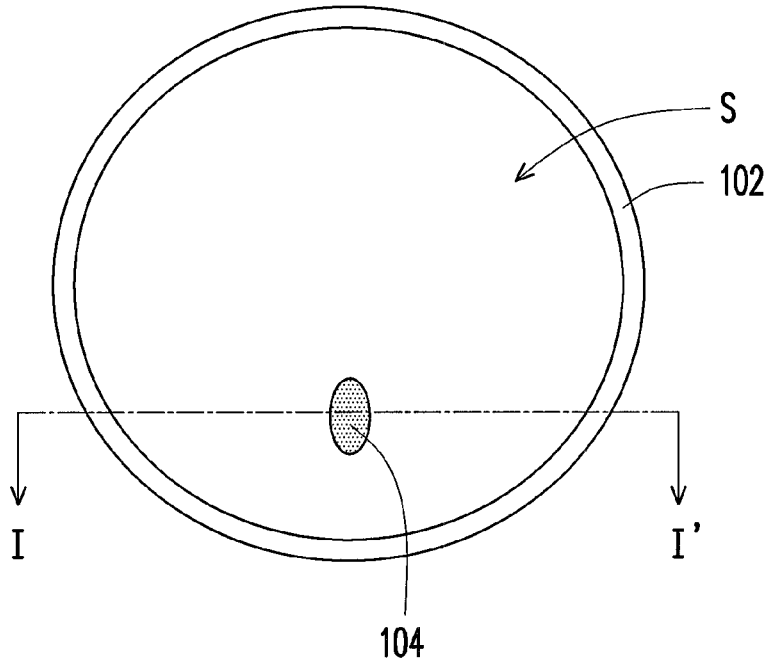
FIGS. 1A~1D are schematic top views of a method of manufacturing a polishing pad having a detection window according to an embodiment of the invention.

FIGS. 1A~1D are schematic top views of a method of manufacturing a polishing pad having a detection window according to an embodiment of the invention. FIGS. 2A to 2D are schematic cross-sectional views along a line I-I' in FIGS. 1A to 1D. Referring to FIG. 1A and FIG. 2A, a mold 102 is first provided, and the mold 102 has an accommodating space S for accommodating a material to be filled into the mold. In the present embodiment, the shape and size of the accommodating space S of the mold 102 is related to the shape and size of a polishing pad to be subsequently formed. In order for persons skilled in the art to understand the invention clearly, the mold 102 is partially illustrated in following figures. That is, an upper lid structure of the mold 102 is omitted.

A dummy detection window 104 is pre-disposed on a specific location in the accommodating space S of the mold 102. This specific location corresponds to a location of an optical detection system in a polishing apparatus. The shape and size of the dummy detection window 104 are identical or similar to the shape and size of the detection window to be subsequently formed in the polishing pad. In the present embodiment, the thickness of the dummy detection window 104 and the depth of the accommodating space S are about the same. The thickness of the dummy detection window 104 can be adjusted to be little thicker than the depth of the accommodating space S as the dummy detection window 104 is slightly compressed when compressed by the upper lid structure of the mold 102. However, the thickness of the dummy detection window 104 can also be thinner than the depth of the accommodating space S. The dummy detection window 104 is fixed on the specific location of the mold 102 by compressing or adhering the dummy detection window 104 in the accommodating space S between the mold 102 and the upper lid structure. Moreover, the dummy detection window 104 may include a magnetic material, such that the dummy detection window 104 can be fixed on the specific location of the mold 102 by magnetic attachment.

Figure 1B:
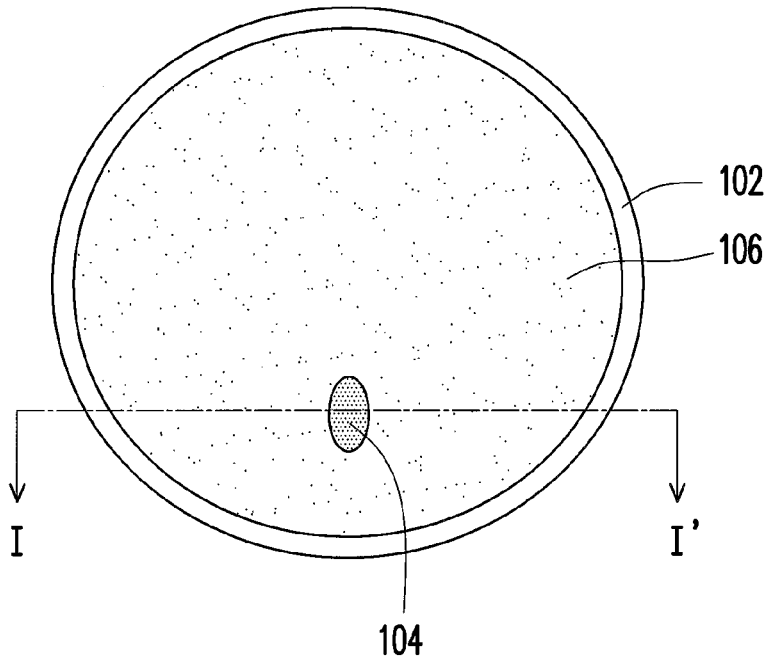
Figure 2A:
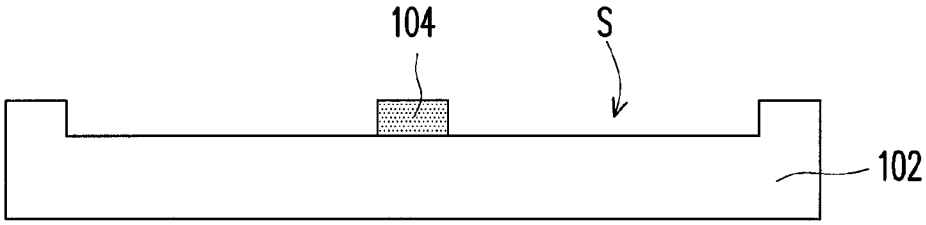
FIGS. 2A to 2D are schematic cross-sectional views along a line I-I' in FIGS. 1A to 1D.
Figure 2B:
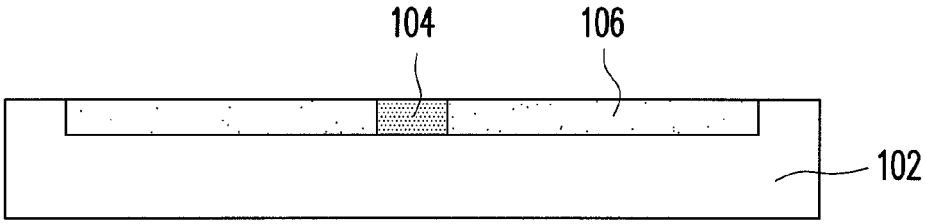

Next, referring to FIG. 1B and FIG. 2B, a polishing layer precursor 106 is filled into the mold 102. The polishing layer precursor 106 is usually in a liquid state; thus, the accommodating space S in the mold 102 can be filled by injecting or pouring. When the polishing layer precursor 106 is injected or poured, the mold 102 is sealed by the upper lid structure and only a filling inlet is exposed. Since the dummy detection window 104 is pre-disposed in the accommodating space S of the mold 102, the polishing layer precursor 106 fills the accommodating space S which is not occupied by the dummy detection window 104. When the thickness of the dummy detection window 104 is about the same as or little thicker than the depth of the accommodating space S, the injected polishing layer precursor 106 encloses the peripheral surface of the dummy detection window 104. When the thickness of the dummy detection window 104 is thinner than the depth of the accommodating space S, the injected polishing layer precursor 106 not only encloses the peripheral surface of the dummy detection window 104, but also covers the upper surface of the dummy detection window 104. After the polishing layer precursor 106 is filled into the mold 102, a solidifying process (such as a curing process) is performed so that the polishing layer precursor 106 is solidified to form a polishing layer 106. The foregoing solidifying process is, for example, a polymerization reaction carried out intrinsically by reactants in the polishing layer precursor 106, or a polymerization reaction of the polishing layer precursor 106 induced extrinsically by an irradiation process or a heating process.

Particularly, the polishing layer 106 and the dummy detection window 104 are separable completely. In other words, a bonding strength between the polishing layer 106 and the dummy detection window 104 is relatively weak. For example, a surface energy difference of the dummy detection window 104 and the polishing layer 106 is greater than 10 mN/m. As a consequence, the polishing layer 106 and the dummy detection window 104 can be easily separated by a small exerted force.

In order to make the polishing layer 106 and the dummy detection window 104 be separable completely, the respective materials of the polishing layer 106 and the dummy detection window 104 are specifically adopted in the present embodiment. For instance, the polishing layer 106 is formed by adopting a polar material and the dummy detection window 104 is formed by adopting a non-polar material or weak polar material. In details, a material of the dummy detection window 104 may include fluoropolymer, polysiloxane, high density polyethylene, low density polyethylene, or polypropylene.

According to other embodiments, the dummy detection window 104 can also be made of decomposable or dissolvable material. The decomposable or dissolvable material may include polyvinyl alcohol, polylactic acid, polyglucose, cyclodextrin, polystyrene, or salt. When the dummy detection window 104 is made of the decomposable or dissolvable material, the dummy detection window 104 and the polishing layer 106 can then be separated by performing a decomposition or dissolving process.

The dummy detection window 104 may be an opaque dummy detection window, having black, red, blue, or other dark colors, for example, such that an obvious color difference shown between the dummy detection window 104 and the light-colored mold 102 (i.e. a metallic color close to gray). Accordingly, the accuracy of the alignment is enhanced when pre-disposing the dummy detection window 104 on the specific location of the mold 102. The polishing layer 106 is made of polyester, polyether, polyurethane, polycarbonate, polyacrylate, polybutadiene, epoxy resin, unsaturated polyester, or ethylene-vinyl acetate copolymer, for instance. According to an embodiment of the invention, the polishing layer 106 is made of a material in light color, such as white, gray, light yellow, or other light colors. Therefore, the light-colored polishing layer 106 and the dark-colored dummy detection window 104 have an obvious color difference, and then the location of the dummy detection window 104 on the polishing layer 106 can be identified easily.

Figure 1C:
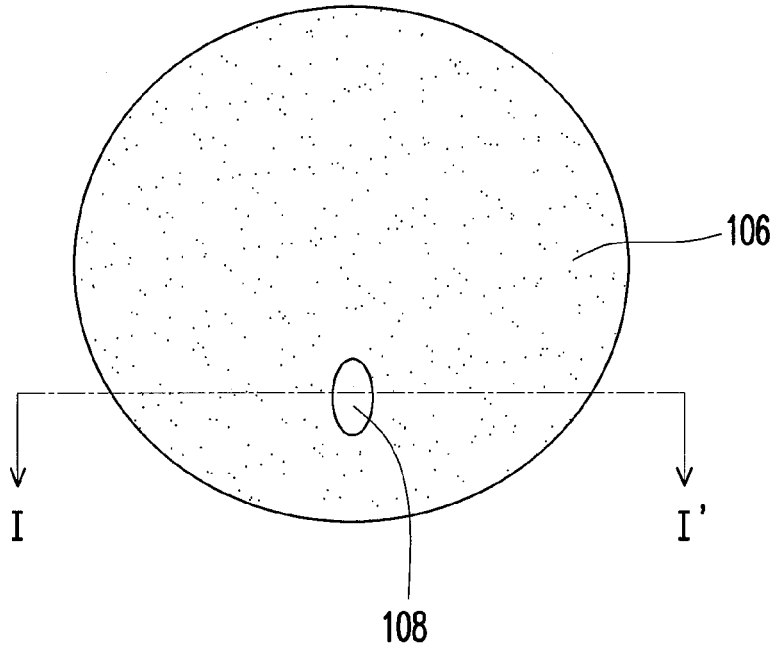
Figure 2C:
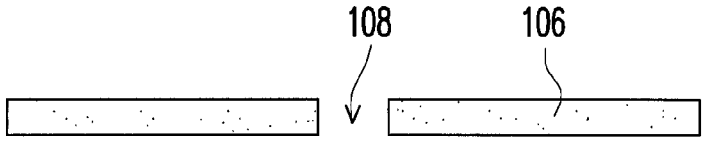

The dummy detection window 104 and the polishing layer 106 are separated completely so as to form a detection opening 108 in the polishing layer 106. As shown in FIG. 1C and FIG. 2C, the shape and size of the detection opening 108 are about the same as those of the dummy detection window 104. When the thickness of the dummy detection window 104 is about the same as or little thicker than the depth of the accommodating space S, the detection opening 108 penetrates from the top surface to the bottom surface of the polishing layer 106. The detection opening 108 is thus a through opening (i.e. a through hole). When the thickness of the dummy detection window 104 is thinner than the depth of the accommodating space S, the detection opening 108 is then formed on the bottom surface of the polishing layer 106, but does not penetrate the top surface. Accordingly, the detection opening 108 is a blind opening (i.e. a blind hole). Since the bonding strength between the polishing layer 106 and the dummy detection window 104 is relatively weak, the dummy detection window 104 can be separated from the polishing layer 106 completely by lightly exerting a force thereon. When the dummy detection window 104 is made of the decomposable or dissolvable material, the dummy detection window 104 can then be decomposed or dissolved by a decomposition or dissolving process, such that the detection opening 108 is formed in the polishing layer 106.

Figure 1D:
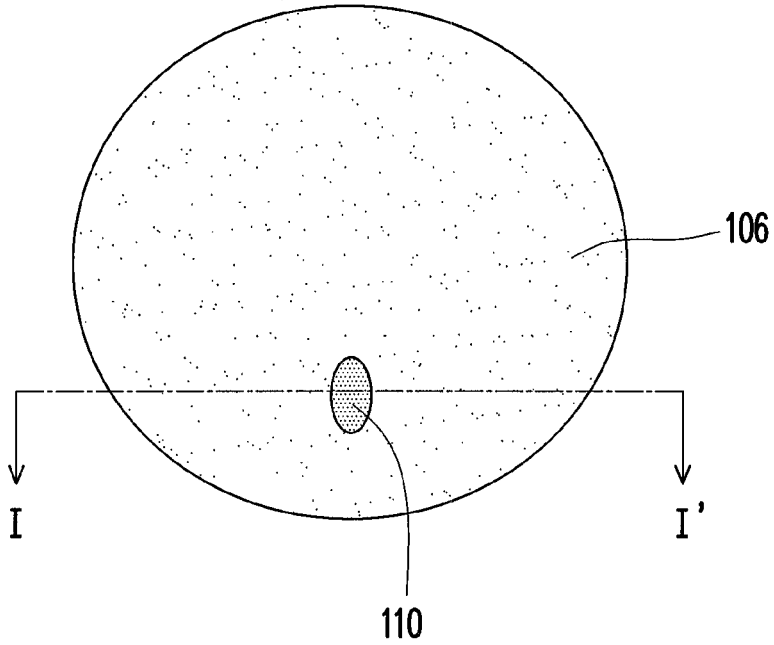
Figure 2D:
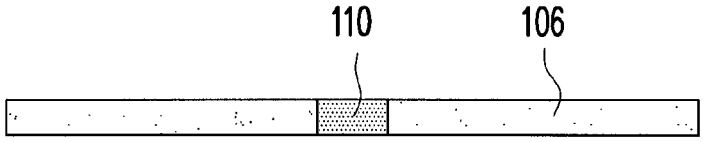

Referring to FIG. 1D and FIG. 2D, a detection window precursor 110 is filled into the detection opening 108. The detection window precursor 110 is usually in a liquid state; thus, the detection opening 108 can be filled by injecting or pouring the detection window precursor 110. Thereafter, a solidifying process (such as a curing process) is performed so as to solidify the detection window precursor 110 for forming a detection window 110. The foregoing solidifying process is, for example, a polymerization reaction carried out intrinsically by reactants in the detection window precursor 110, or a polymerization reaction of the detection window precursor 110 induced extrinsically by an irradiation process or a heating process. In the present embodiment, the material of the detection window 110 includes a material enabling the light used by the optical detection system to have a transmittance of at least 50%, for example. This light may be a red light with a wavelength ranging from 600 nm to 700 nm or a white light with a wavelength ranging from 400 nm to 700 nm.

According to an embodiment of the invention, after the solidifying process is performed for solidifying the detection window precursor 110 to form the detection window 110, a surface flattening process is performed to the polishing layer 106. In the so-called surface flattening process, the upper surface layer of the polishing layer 106 is trimmed by mechanical trimming, so that the upper surface of the polishing layer 106 has a flat surface. The upper surface layer of the detection window 110 may also be trimmed in the surface flattening process, so that the upper surface of the detection window 110 exposed has the same flat surface as the polishing layer 106.

According to other embodiments of the invention, after the solidifying process is performed for solidifying the detection window precursor 110 to form the detection window 110, a grooving process is performed to form groove(s) of a specific shape or distribution in the polishing layer 106 (not shown). In another embodiment, the corresponding pattern with protrusion(s) complementary to predetermined groove(s) can be designed within the mold 102 of FIG. 2A. The groove(s) (not shown) can then be formed in the polishing layer 106 consequently after the processes of filling and solidifying the polishing layer precursor 106 depicted in FIG. 2B.

In the foregoing embodiment, the detection opening is formed in the polishing layer by pre-disposing the dummy detection window. However, the invention is not limited thereto, and other methods can be adopted to replace the dummy detection window in other embodiments. The detailed description is given as follows.

FIGS. 3A~3D are schematic top views of a method of manufacturing a polishing pad having a detection window according to an embodiment of the invention. FIGS. 4A to 4D are schematic cross-sectional views along a line II-II' in FIGS. 3A to 3D. Embodiments in FIGS. 3A to 3D and FIGS. 4A to 4D are similar to the embodiments in FIGS. 1A to 1D and FIGS. 2A to 2D; thus, the same elements are denoted with the same notations and are not repeated hereinafter.

Figure 3A:
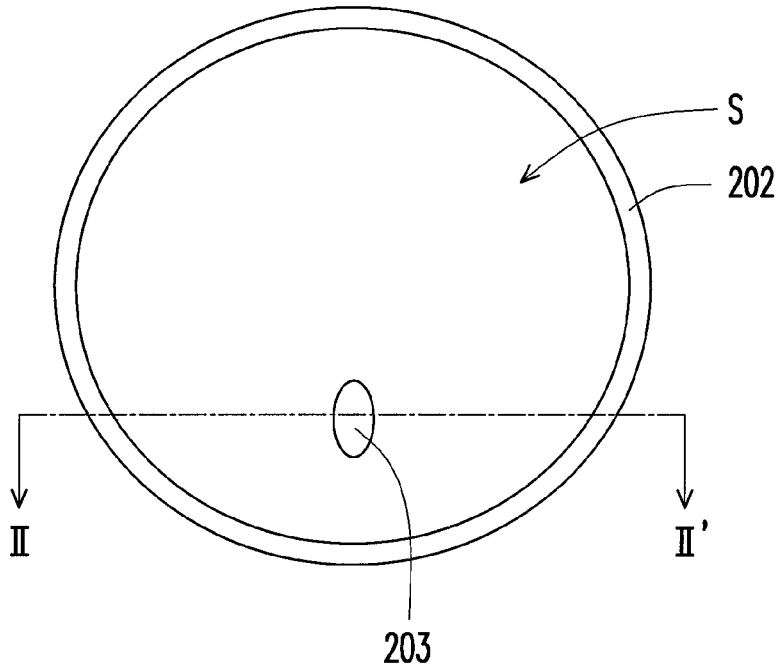
FIGS. 3A~3D are schematic top views of a method of manufacturing a polishing pad having a detection window according to an embodiment of the invention.
Figure 4A:
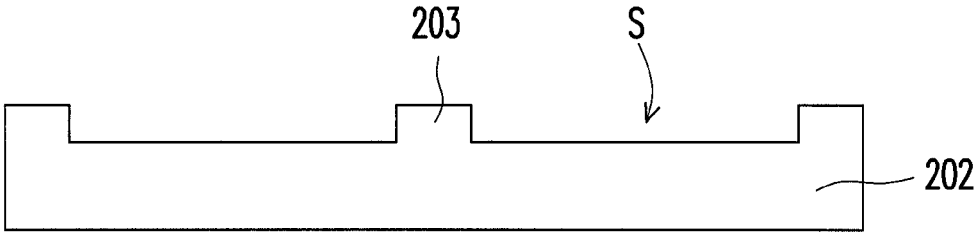
FIGS. 4A to 4D are schematic cross-sectional views along a line II-II' in FIGS. 3A to 3D.

Referring to FIG. 3A and FIG. 4A, a mold 202 having a protrusion structure 203 and an accommodating space S is provided. The protrusion structure 203 is disposed within the accommodating space S of the mold 202. The accommodating space S is configured to accommodate a material to be filled into the mold 202. The location of the protrusion structure 203 corresponds to the location of the optical detection system of the polishing apparatus. In the present embodiment, the shape and size of the accommodating space S of the mold 202 is corresponding to the shape and size of a polishing pad to be subsequently formed. In order for persons skilled in the art to understand the invention clearly, the mold 202 is partially illustrated in following figures. That is, an upper lid structure of the mold 202 is omitted. In addition, the shape and size of the protrusion structure 203 are identical or similar to the shape and size of the detection window to be subsequently formed in the polishing pad. In the present embodiment, the thickness of the protrusion structure 203 is about the same as the depth of the accommodating space S. According to another embodiment, the thickness of the protrusion structure 203 can also be thinner than the depth of the accommodating space S.

Figure 3B:
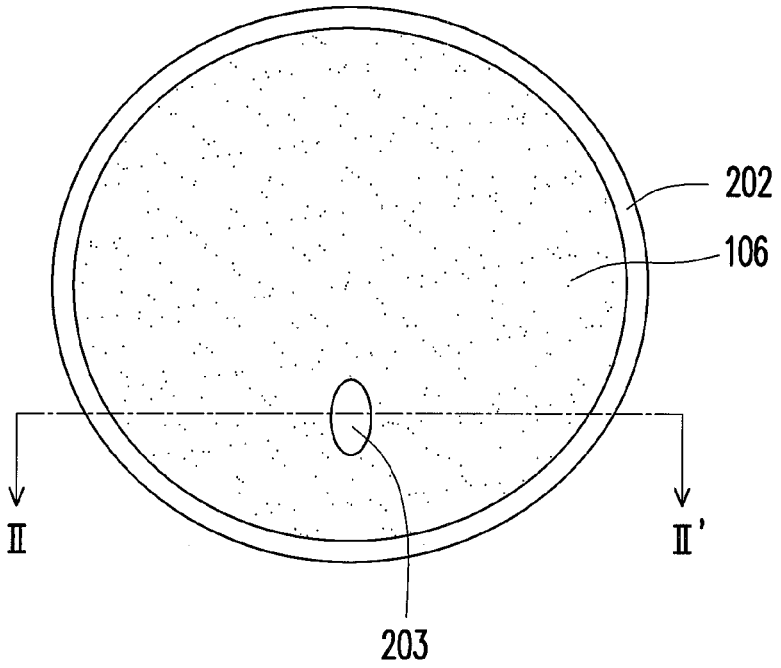
Figure 4B:
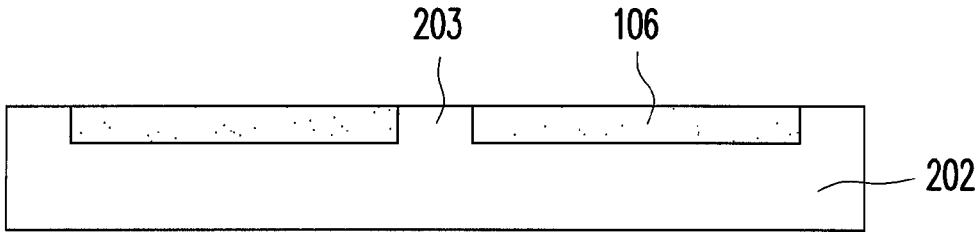

Referring to FIG. 3B and FIG. 4B, a polishing layer precursor 106 is filled into the mold 202. After the polishing layer precursor 106 is filled into the mold 202, a solidifying process (such as a curing process) is performed so that the polishing layer precursor 106 is solidified to form a polishing layer 106.

Figure 3C:
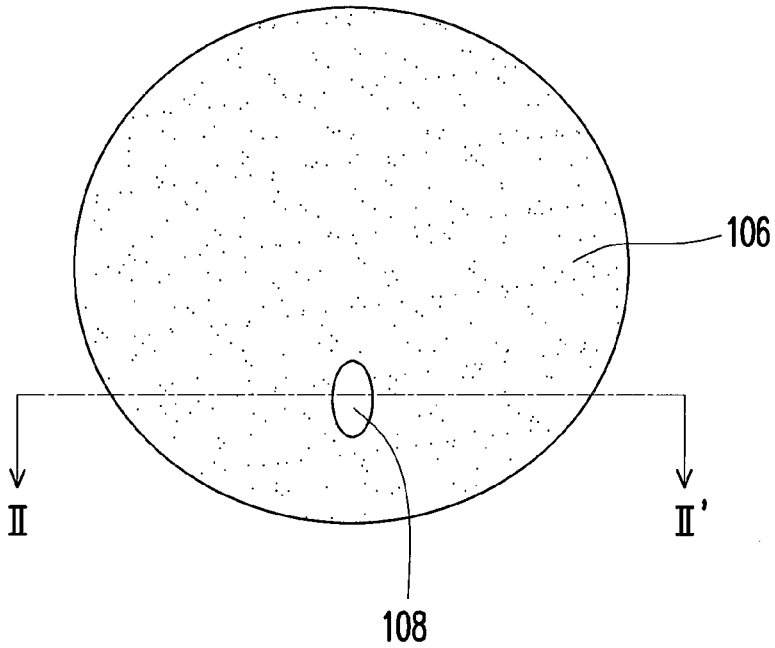
Figure 4C:
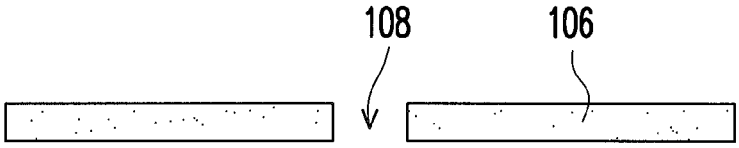

Since the mold 202 has the protrusion structure 203, the polishing layer 106 is merely formed in the accommodating space S not disposed with the protrusion structure 203. Therefore, after a demolding process is performed, the protrusion structure 203 defines a detection opening 108 in the polishing layer 106 as shown in FIG. 3C and FIG. 4C. The detection opening 108 penetrates from the top surface to the bottom surface of the polishing layer 106, and is therefore a through opening (i.e. a through hole). Moreover, the shape and size of the detection opening 108 are about the same as those of the protrusion structure 203. In the foregoing example, the thickness of the protrusion structure 203 and the depth of the accommodating space S are about the same. However, when the thickness of the protrusion structure 203 is thinner than the depth of the accommodating space S, the detection opening 108 formed is then a blind opening (i.e. a blind hole).

Figure 3D:
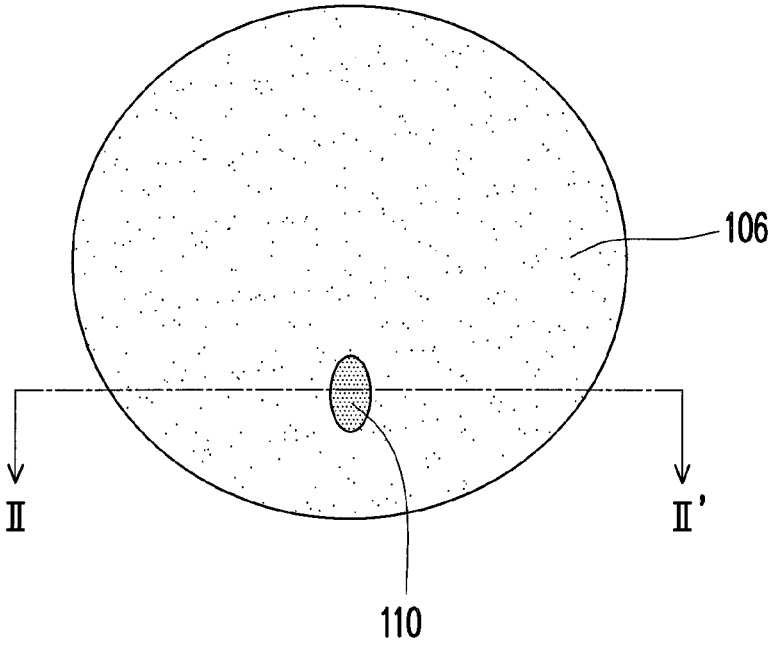
Figure 4D:
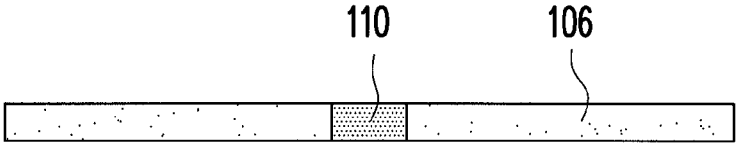

Referring to FIG. 3D and FIG. 4D, a detection window precursor 110 is filled into the detection opening 108. The detection window precursor 110 is usually in a liquid state; thus, the detection opening 108 can be filled by injecting or pouring the detection window precursor 110. A solidifying process (such as a curing process) is performed so as to solidify the detection window precursor 110 for forming a detection window 110.

Similarly, after the solidifying process is performed for solidifying the detection window precursor 110 to form the detection window 110, a surface flattening process is performed to the polishing layer 106. In the so-called surface flattening process, the upper surface layer of the polishing layer 106 is trimmed by mechanical trimming, so that the upper surface of the polishing layer 106 has a flat surface. The upper surface layer of the detection window 110 may also be trimmed in the surface flattening process, so that the upper surface of the detection window 110 exposed has the same flat surface as the polishing layer 106.

According to other embodiments of the invention, after the solidifying process is performed for solidifying the detection window precursor 110 to form the detection window 110, a grooving process is performed to form groove(s) (not shown) of a specific shape or distribution in the polishing layer 106. In another embodiment, the corresponding pattern with protrusion(s) complementary to predetermined groove(s) can be designed within the mold 202 of FIG. 4A. The groove(s) (not shown) can then be formed in the polishing layer 106 consequently after the processes of filling and solidifying the polishing layer precursor 106 depicted in FIG. 4B.

The method of forming the polishing layer 106 and the subsequent detection window 110 in the mold 202, and the materials and characteristics of the polishing layer 106 and the detection window 110 are identical to those described in the embodiments of FIG. 1A to FIG. 2D, and the descriptions thereof are therefore omitted.

In light of the foregoing, since the present embodiment does not require mechanical cutting tool to manufacture the detection opening, the method of the present embodiment has the advantage of simpler procedure and/or lower manufacturing cost comparing with the conventional method.

Second Embodiment

FIGS. 5A~5E are schematic top views of a method of manufacturing a polishing pad having a detection window according to an embodiment of the invention. FIGS. 6A to 6E are schematic cross-sectional views along a line III-III' in FIGS. 5A to 5E. Embodiments in FIGS. 5A to 5C and FIGS. 6A to 6C are similar to the embodiments in FIGS. 1A to 1C and FIGS. 2A to 2C; thus, the same elements are denoted with the same notations and are not repeated hereinafter. In particular, steps illustrated in FIGS. 5A to 5C and FIGS. 6A to 6C are identical or similar to the steps depicted in FIGS. 1A to 1C and FIGS. 2A to 2C.

Figure 5A:
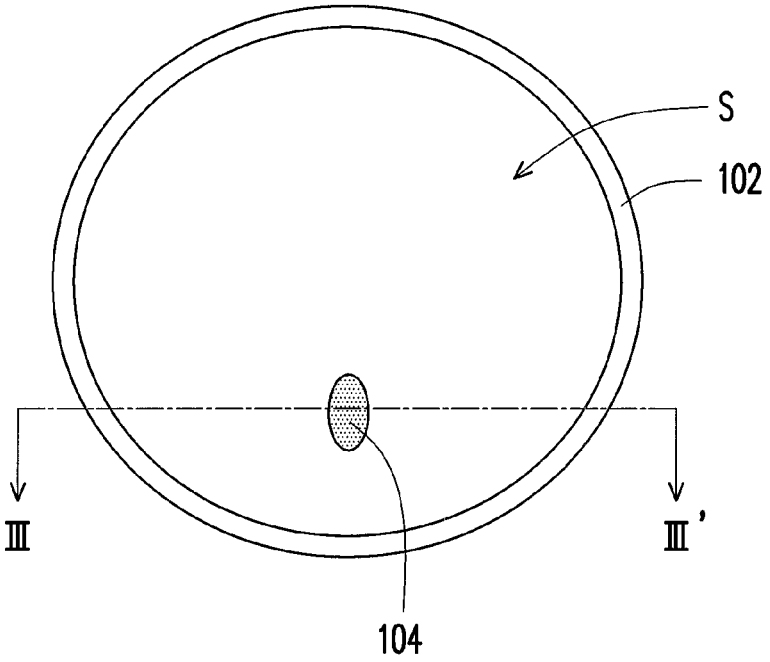
FIGS. 5A~5E are schematic top views of a method of manufacturing a polishing pad having a detection window according to an embodiment of the invention.
Figure 5B:
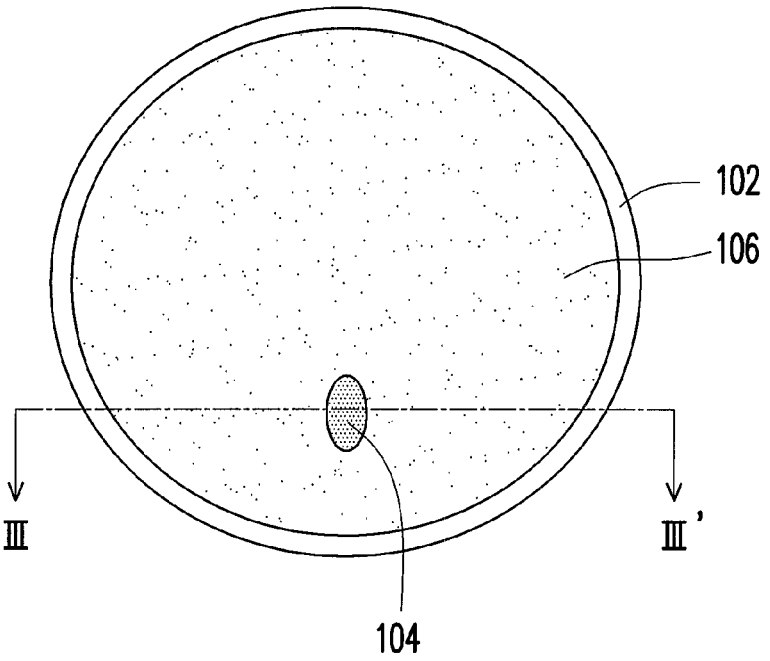
Figure 6A:
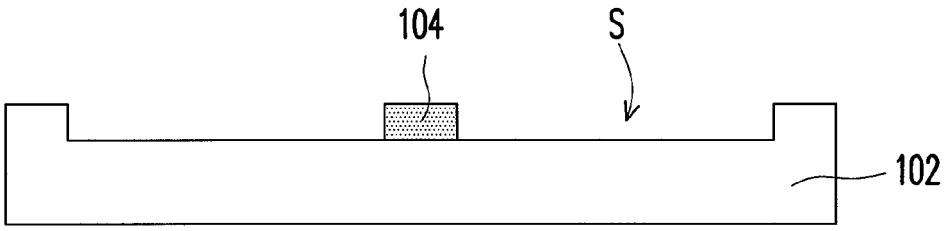
FIGS. 6A to 6E are schematic cross-sectional views along a line III-III' in FIGS. 5A to 5E.
Figure 6B:
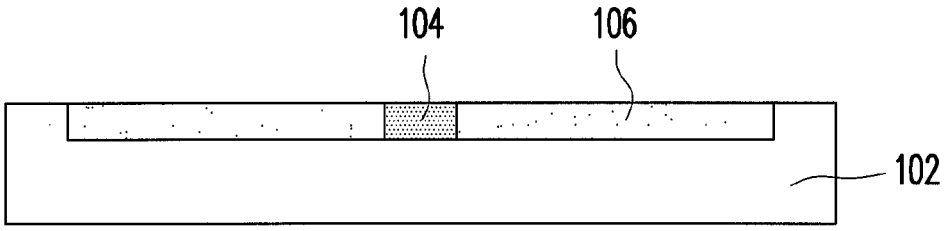

Referring to FIG. 5A and FIG. 6A, a mold 102 having an accommodating space S is first provided. A dummy detection window 104 is pre-disposed on a specific location in the accommodating space S. This specific location corresponds to a location of an optical detection system in a polishing apparatus. Referring to FIG. 5B and FIG. 6B, a polishing layer precursor 106 is filled into the mold 102. The method of filling the polishing layer precursor 106 into the mold 102 and the characteristics of the polishing layer precursor 106 are all similar to those illustrated in the foregoing embodiments, and are thus omitted herein. After the polishing layer precursor 106 is filled into the mold 102, a solidifying process (such as a curing process) is performed so that the polishing layer precursor 106 is solidified to form a polishing layer 106. Similarly, the polishing layer 106 and the dummy detection window 104 are separable completely. For example, a surface energy difference of the dummy detection window 104 and the polishing layer 106 is greater than 10 mN/m. As a consequence, the polishing layer 106 and the dummy detection window 104 can be easily separated by a small exerted force.

In the present embodiment, the polishing layer 106 is formed by adopting a polar material and the dummy detection window 104 is formed by adopting a non-polar material or weak polar material. According to other embodiments, the dummy detection window 104 can also be made of decomposable or dissolvable material. The exemplary embodiments regarding the materials of the dummy detection window 104 and the polishing layer 106 are described in the First Embodiment, and are not repeated hereinafter.

Figure 5C:
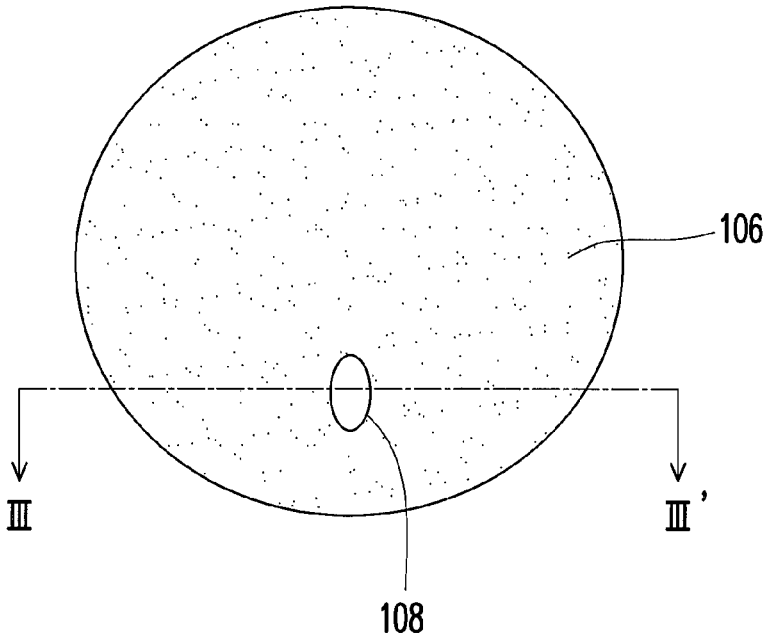
Figure 6C:
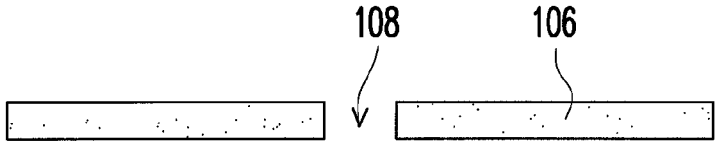

As depicted in FIG. 5C and FIG. 6C, the dummy detection window 104 and the polishing layer 106 are separated completely to form a detection opening 108 in the polishing layer 106. The formed detection opening 108 may penetrate from the top surface to the bottom surface of the polishing layer 106. The detection opening 108 is thereby a through opening (i.e. a through hole). Further, the detection opening 108 may also be designed to be formed on the bottom surface of the polishing layer 106. However, the detection opening 108 does not penetrate the top surface. The detection opening 108 is thus a blind opening (i.e. a blind hole).

Figure 5D:
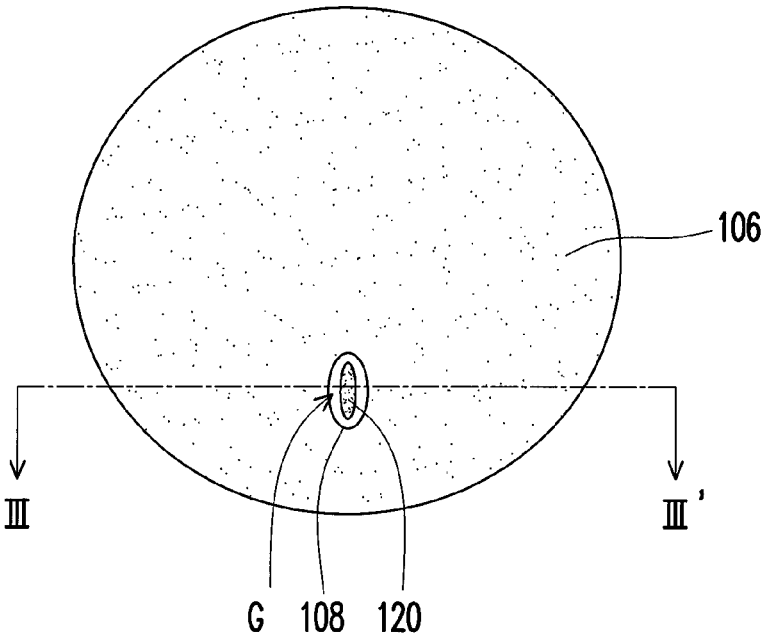
Figure 6D:
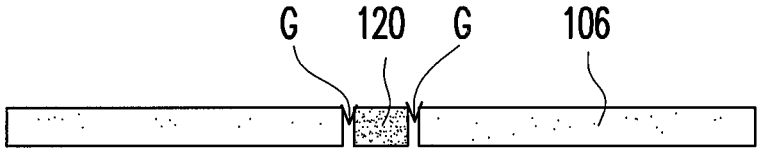

Referring to FIG. 5D and FIG. 6D, a detection window 120 is disposed in the detection opening 108, where a gap G is present between the peripheral surface of the detection window 120 and an inner side surface of the detection opening 108. The detection window 120 is a detection window in a solid state. According to an embodiment of the invention, the material of the detection window 120 includes a material enabling the light used by the optical detection system to have a transmittance of at least 50%, for example. This light may be a red light with a wavelength ranging from 600 nm to 700 nm or a white light with a wavelength ranging from 400 nm to 700 nm.

Figure 5E:
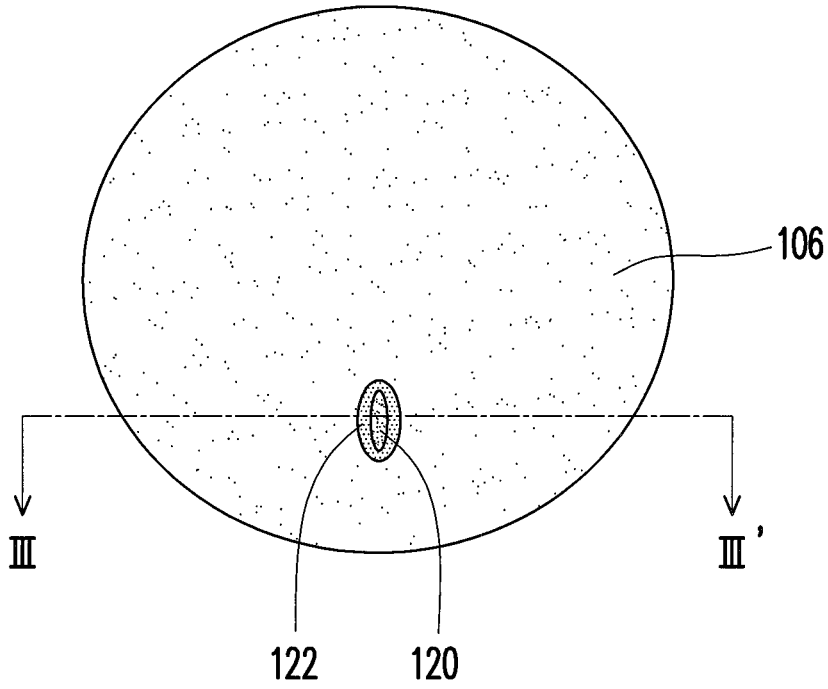
Figure 6E:
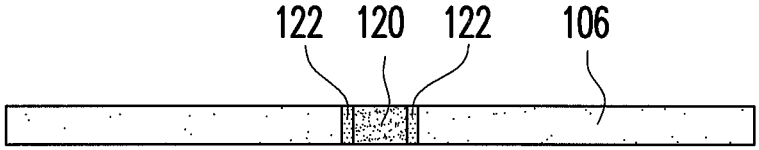

Referring to FIG. 5E and FIG. 6E, a liquid state buffer layer 122 is filled into the gap G between the peripheral surface of the detection window 120 and the inner side surface of the detection opening 108. Since the buffer layer 122 filled is a liquid state, the gap G can be filled by injecting or pouring the buffer layer 122. A solidifying process (such as a curing process) is performed so as to solidify the liquid state buffer layer 122 for forming a solid state buffer layer 122. The foregoing solidifying process is, for example, a polymerization reaction carried out intrinsically by reactants in the liquid state buffer layer 122, or a polymerization reaction of the liquid state buffer layer 122 induced extrinsically by an irradiation process or a heating process. According to an embodiment of the invention, the material of the buffer layer 122 includes a material enabling the light with a wavelength ranging from 600 nm to 700 nm to have a transmittance of at least 50%, for example. Furthermore, the buffer layer 122 may also be formed by adopting an energy absorbing material. In the present embodiment, the polishing layer 106 may be formed by adopting an aromatic-rich material, the detection window 120 may be formed by adopting an aliphatic-rich material, and a material of the buffer layer 122 ranges therebetween (i.e. the material of the buffer layer 122 has an aromatic functional group content ranging between the polishing layer 106 and the detection window 120).

According to an embodiment of the invention, after the solidifying process is performed for solidifying the liquid state buffer layer 122 to form a solid state buffer layer 122, a surface flattening process is performed to the polishing layer 106. In the so-called surface flattening process, the upper surface layer of the polishing layer 106 is trimmed by mechanical trimming, so that the upper surface of the polishing layer 106 has a flat surface. The upper surface layer of the buffer layer 122 and the detection window 120 may also be trimmed in the surface flattening process, so that the upper surface of the buffer layer 122 and the detection window 120 exposed has the same flat surface as the polishing layer 106. According to other embodiments of the invention, after the solidifying process is performed to the buffer layer 122, a grooving process is performed to form groove(s) of a specific shape or distribution in the polishing layer 106 (not shown). In another embodiment, the corresponding pattern with protrusion(s) complementary to predetermined groove(s) can be designed within the mold 102 of FIG. 6A. The groove(s) (not shown) can then be formed in the polishing layer 106 consequently after the processes of filling and solidifying the polishing layer precursor 106 depicted in FIG. 6B.

In the foregoing embodiment, the detection opening is formed in the polishing layer by pre-disposing the dummy detection window. However, the invention is not limited thereto, and other methods can be adopted to replace the dummy detection window in other embodiments. The detailed description is given as follows.

FIGS. 7A~7E are schematic top views of a method of manufacturing a polishing pad having a detection window according to an embodiment of the invention. FIGS. 8A to 8E are schematic cross-sectional views along a line IV-IV' in FIGS. 7A to 7E. Embodiments in FIGS. 7A to 7C and FIGS. 8A to 8C are similar to the embodiments in FIGS. 3A to 3C and FIGS. 4A to 4C; thus, the same elements are denoted with the same notations and are not described hereinafter. Especially, steps illustrated in FIGS. 7A to 7C and FIGS. 8A to 8C are identical or similar to the steps depicted in FIGS. 3A to 3C and FIGS. 4A to 4C. Embodiments in FIGS. 7D to 7E and FIGS. 8D to 8E are similar to the embodiments in FIGS. 5D to 5E and FIGS. 6D to 6E; thus, the same elements are denoted with the same notations and are not described hereinafter. Especially, steps illustrated in FIGS. 7D to 7E and FIGS. 8D to 8E are identical or similar to the steps depicted in FIGS. 5D to 5E and FIGS. 6D to 6E.

Figure 7A:
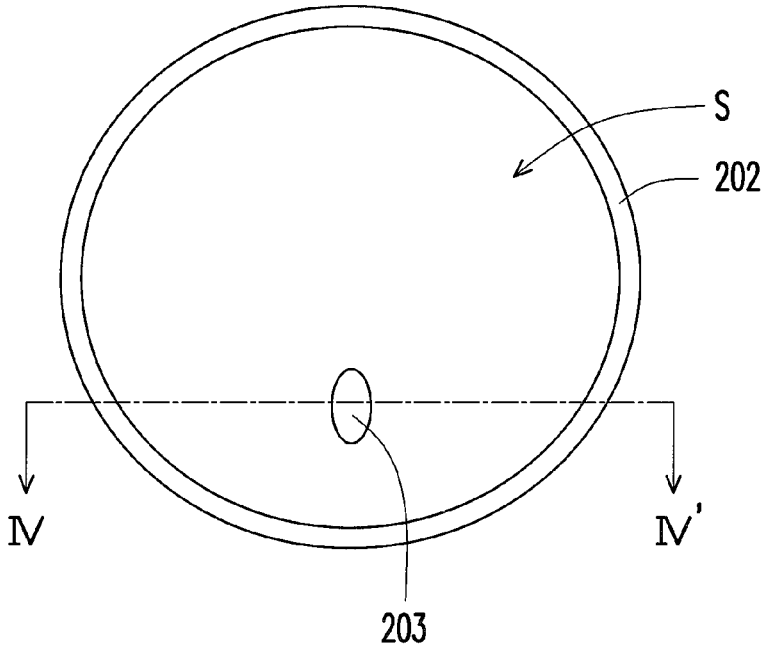
FIGS. 7A~7E are schematic top views of a method of manufacturing a polishing pad having a detection window according to an embodiment of the invention.
Figure 7B:
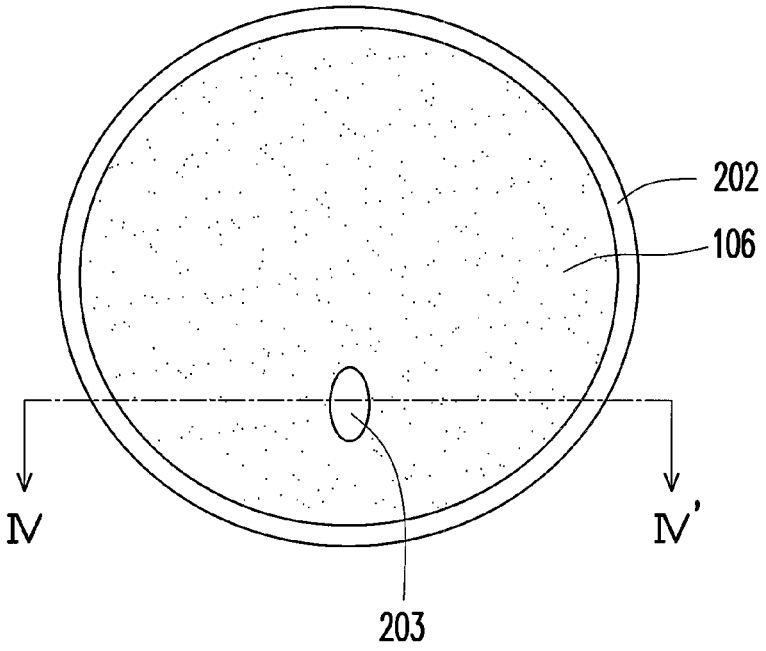
Figure 8A:
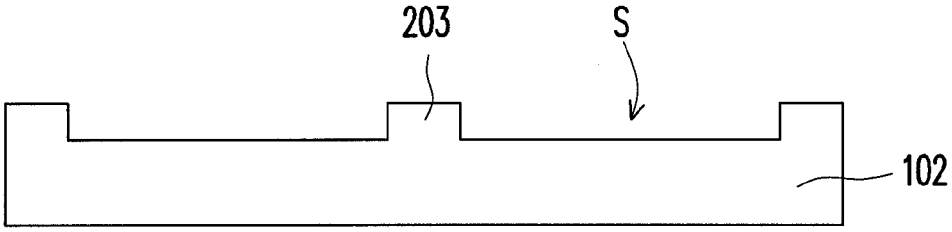
FIGS. 8A to 8E are schematic cross-sectional views along a line IV-IV' in FIGS. 7A to 7E.
Figure 8B:
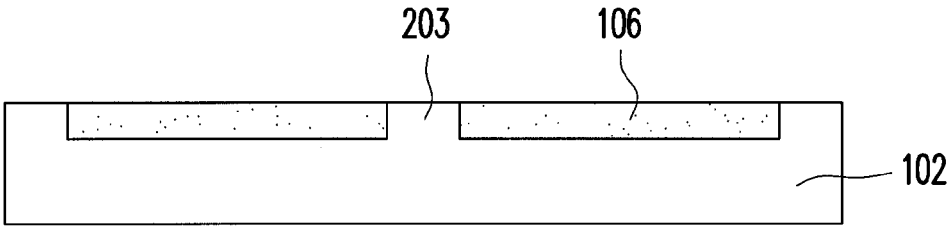

Referring to FIG. 7A and FIG. 8A, a mold 202 having a protrusion structure 203 and an accommodating space S is provided. The location of the protrusion structure 203 corresponds to the location of the optical detection system of the polishing apparatus. Referring to FIG. 7B and FIG. 8B, a polishing layer precursor 106 is filled into the mold 202. The method of filling the polishing layer precursor 106 into the mold 202 and the characteristics of the polishing layer precursor 106 are all similar to those illustrated in the foregoing embodiments, and are thus omitted herein. After the polishing layer precursor 106 is filled into the mold 202, a solidifying process (such as a curing process) is performed so that the polishing layer precursor 106 is solidified to form a polishing layer 106.

Figure 7C:
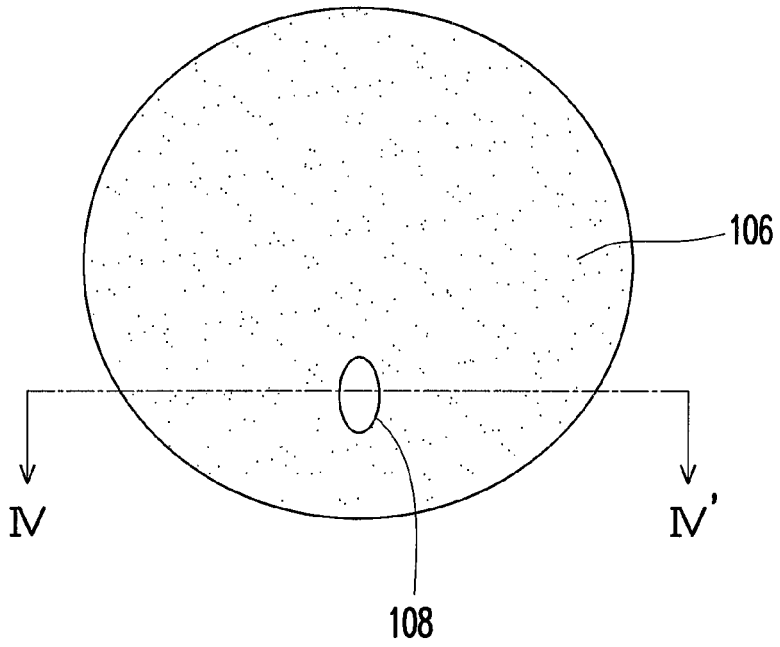
Figure 8C:
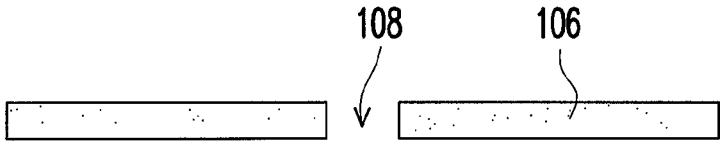

Since the mold 202 has the protrusion structure 203, the polishing layer 106 is merely formed in the accommodating space S where the protrusion structure 203 is not disposed. Therefore, after a demolding process is performed, the protrusion structure 203 defines a detection opening 108 in the polishing layer 106 as shown in FIG. 7C and FIG. 8C. The detection opening 108 may penetrate from the top surface to the bottom surface of the polishing layer 106, and is therefore a through opening (i.e. a through hole). Moreover, the shape and size of the detection opening 108 are about the same as those of the protrusion structure 203. Moreover, the detection opening 108 formed in the polishing layer 106 may also be a blind opening (i.e. a blind hole) through the design of the protrusion structure 203.

Figure 7D:
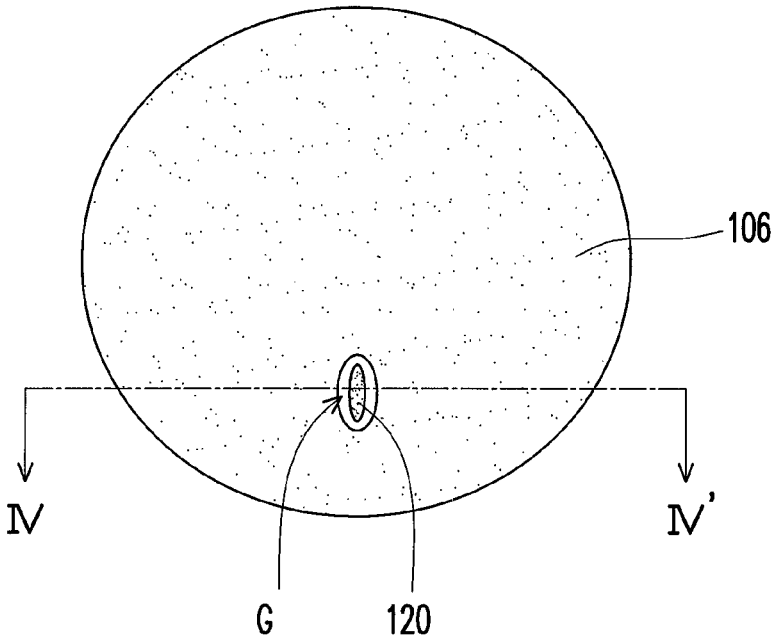
Figure 8D:
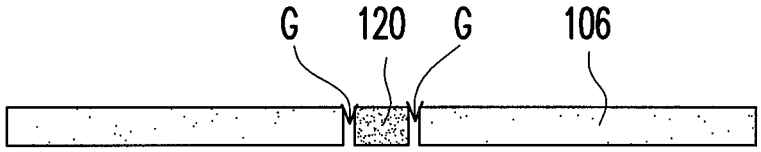

Referring to FIG. 7D and FIG. 8D, a detection window 120 is disposed in the detection opening 108, where a gap G is present between the peripheral surface of the detection window 120 and an inner side surface of the detection opening 108. The detection window 120 is a detection window in a solid state. According to an embodiment of the invention, the material of the detection window 120 includes a material enabling the light used by the optical detection system to have a transmittance of at least 50%, for example. This light may be a red light with a wavelength ranging from 600 nm to 700 nm or a white light with a wavelength ranging from 400 nm to 700 nm.

Figure 7E:
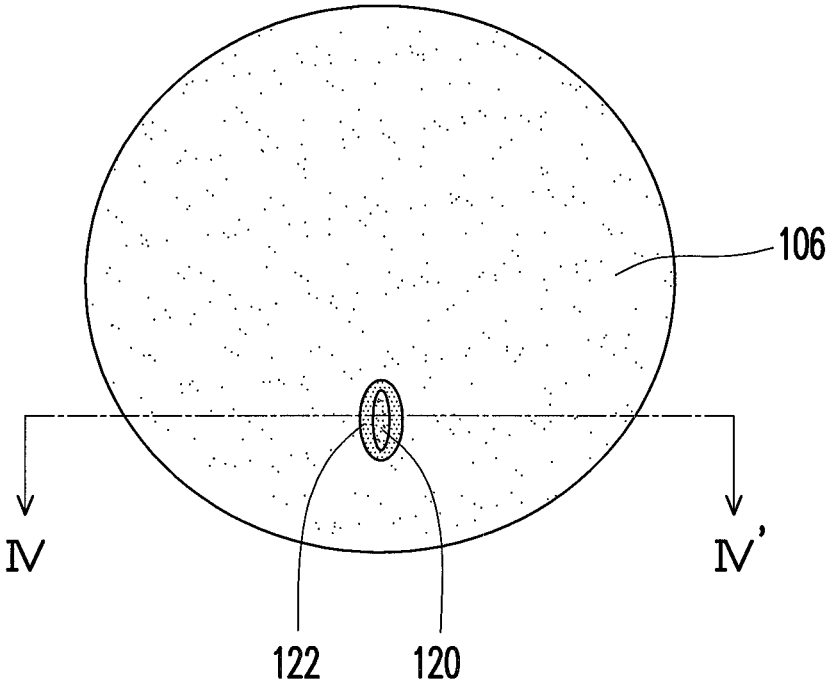
Figure 8E:
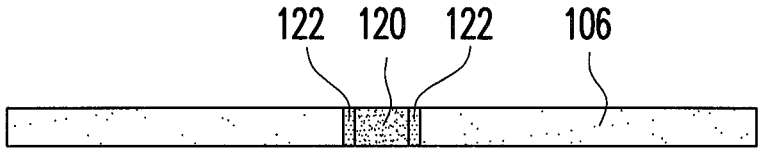

Referring to FIG. 7E and FIG. 8E, a liquid state buffer layer 122 is filled into the gap G between the peripheral surface of the detection window 120 and the inner side surface of the detection opening 108. Since the buffer layer 122 filled is in a liquid state, the gap G can be filled by injecting or pouring the buffer layer 122. A solidifying process (such as a curing process) is performed so as to solidify the liquid state buffer layer 122 for forming the solid state buffer layer 122. The foregoing solidifying process is, for example, a polymerization reaction carried out intrinsically by reactants in the liquid state buffer layer 122 or a polymerization reaction of the liquid state buffer layer 122 induced extrinsically by an irradiation process or a heating process. According to an embodiment of the invention, the material of the buffer layer 122 includes a material enabling the light with a wavelength ranging from 600 nm to 700 nm to have a transmittance of at least 50%, for example. Furthermore, the buffer layer 122 may also be formed by adopting an energy absorbing material. In the present embodiment, the polishing layer 106 may be formed by adopting an aromatic-rich material, the detection window 120 may be formed by adopting an aliphatic-rich material, and a material of the buffer layer 122 ranges therebetween (i.e. the material of the buffer layer 122 has an aromatic functional group content ranging between the polishing layer 106 and the detection window 120).

According to an embodiment of the invention, after the solidifying process is performed for solidifying the liquid state buffer layer 122 to form a solid state buffer layer 122, a surface flattening process is performed to the polishing layer 106. In the so-called surface flattening process, the upper surface layer of the polishing layer 106 is trimmed by mechanical trimming, so that the upper surface of the polishing layer 106 has a flat surface. The upper surface layer of the buffer layer 122 and the detection window 120 may also be trimmed in the surface flattening process, so that the upper surface of the buffer layer 122 and the detection window 120 exposed has the same flat surface as the polishing layer 106. According to other embodiments of the invention, after the solidifying process is performed to the buffer layer 122, a grooving process is performed to form groove(s) of a specific shape or distribution in the polishing layer 106 (not shown). In another embodiment, the corresponding pattern with protrusion(s) complementary to predetermined groove(s) can be designed within the mold 102 of FIG. 8A. The groove(s)) can then be formed in the polishing layer 106 consequently after the processes of filling and solidifying the polishing layer precursor 106 depicted in FIG. 8B. The polishing pad having the detection window formed by using the method described in the Second Embodiment is illustrated in FIG. 5E (FIG. 6E) or FIG. 7E (FIG. 8E), and the polishing pad includes a polishing layer 106, a detection window 120, and a buffer layer 122. The polishing layer 106 has a detection opening 108, the detection window 120 is disposed in the detection opening 108, where a gap G is present between the peripheral surface of the detection window 120 and an inner side surface of the detection opening 108. The gap G is filled with the buffer layer 122. According to an embodiment of the invention, the polishing layer 106 is formed by adopting polyester, polyether, polyurethane, polycarbonate, polyacrylate, polybutadiene, epoxy resin, unsaturated polyester, or ethylene-vinyl acetate copolymer, for instance. The material of the detection window 120 includes a material enabling the light used by the optical detection system to have a transmittance of at least 50%, for example. This light may be a red light with a wavelength ranging from 600 nm to 700 nm or a white light with a wavelength ranging from 400 nm to 700 nm. The material of the buffer layer 122 includes a material enabling the light with a wavelength ranging from 600 nm to 700 nm to have a transmittance of at least 50%, for example. Furthermore, the buffer layer 122 may also be formed by adopting an energy absorbing material. In the present embodiment, the polishing layer 106 may be formed by adopting an aromatic-rich material, the detection window 120 may be formed by adopting an aliphatic-rich material, and a material of the buffer layer 122 ranges therebetween (i.e. the material of the buffer layer 122 has an aromatic functional group content ranging between the polishing layer 106 and the detection window 120).

Figure 9:
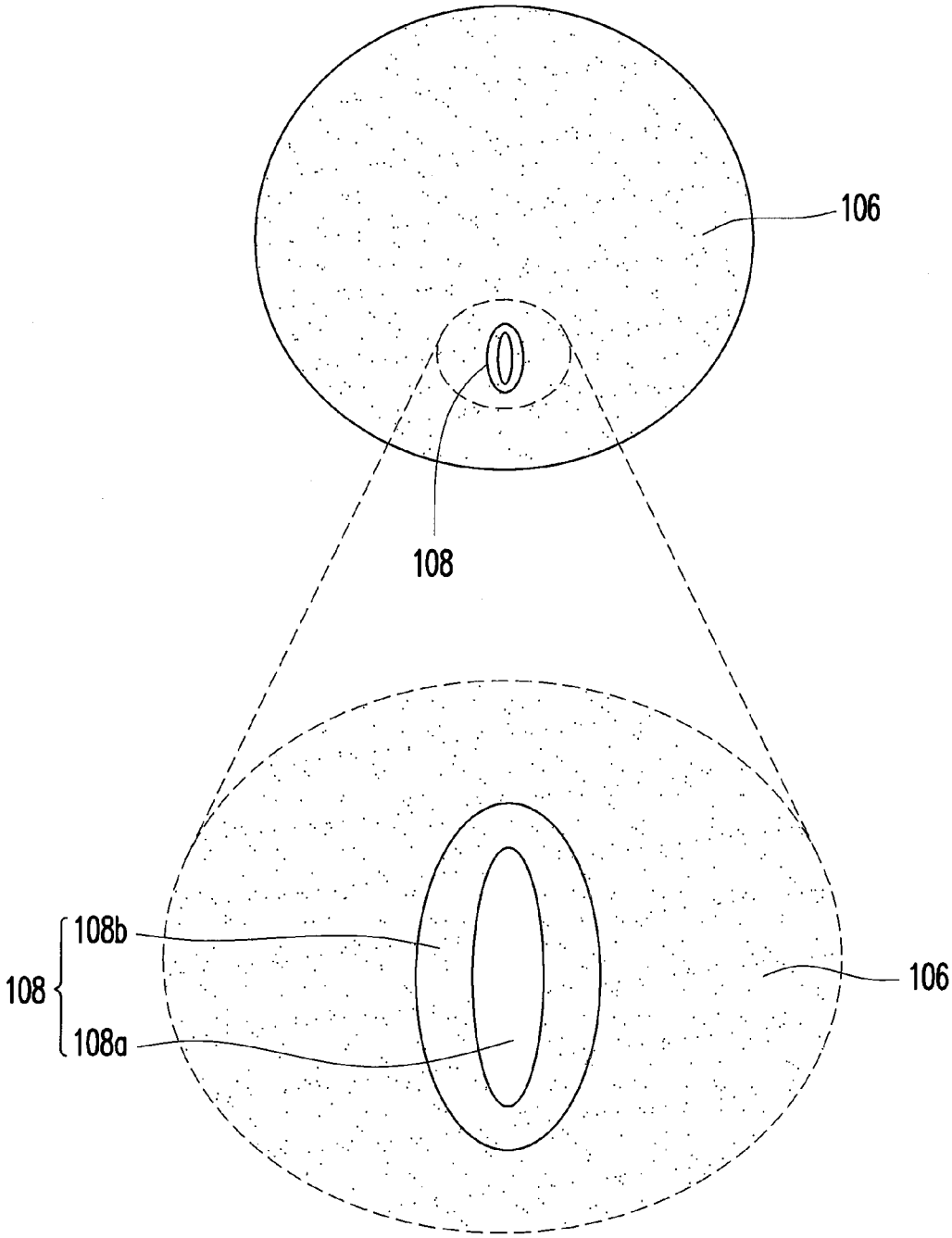
FIGS. 9~10 are schematic top views of a method of manufacturing a polishing pad having a detection window according to an embodiment of the invention.
Figure 10:
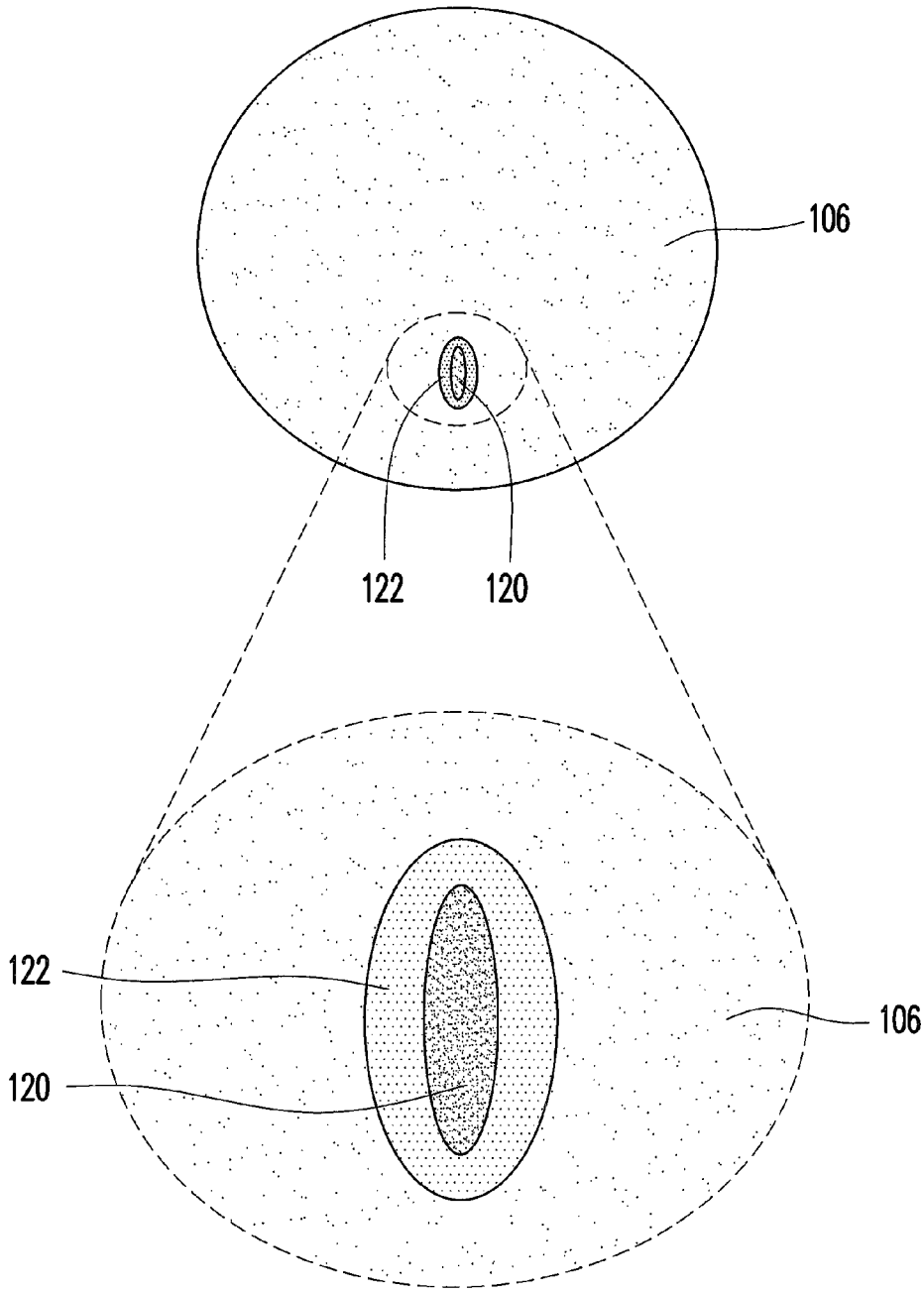

It should be noted that in the embodiments of FIG. 5C and FIG. 7C, the detection opening 108 formed is a through opening having a single size. However, according to other embodiments as illustrated in FIG. 9, the detection opening 108 formed may also have dual sizes which includes a central part 108*a* and a peripheral part 108*b* surrounding the central part 108*a*. The central part 108*a* of the detection opening 108 is a penetrating part and the peripheral part 108*b* of the detection opening 108 is a non-penetrating part. That is, the bottom of the peripheral part 108*b* includes the partial thickness of the polishing layer 106. By designing the detection opening 108 as that shown in FIG. 9, better alignment can be attained in the following steps of disposing the detection window and filling the buffer layer. As depicted in FIG. 10, the detection window 120 is disposed in the central part 108*a* of the detection opening 108. Since the central part 108*a* and the peripheral part 108*b* of the detection opening 108 have a height difference, the peripheral part 108*b* can be used for aligning when the detection window 120 is being disposed. The buffer layer 122 is then filled in the peripheral part 108*b* of the detection opening 108.

In summary, since the embodiments aforementioned do not require mechanical cutting tool to manufacture the detection opening, the method of the present embodiment has the advantage of simpler procedure and/or lower manufacturing cost comparing with the conventional method.

According to the polishing pad having the detection window formed by the methods illustrated in the First Embodiment and the Second Embodiment, the maximum tensile strength of elastic deformation between the detection window and the polishing layer is greater than 85 kgf/cm$^2$, and ranges from 90 kg f/cm$^2$ to 100 kgf/cm$^2$, for example. The polishing pad of the invention has better bonding strength between the detection window and the polishing layer comparing with the conventional method, where a pre-manufactured detection window is disposed in a mold, a polishing layer material is filled into the mold, and a solidifying process is performed to form a polishing pad having the detection window. Table 1 shows a comparison of bonding strength between the detection window and the polishing layer. Here, the polishing layer is formed by adopting aromatic-rich polyurethane, the detection window material B is aliphatic-rich polyurethane, and the material A of the detection window or the buffer layer is polyurethane with an aromatic functional group content ranging between the polishing layer and the detection window material B. In addition, the energy absorbing ability of the material A of the detection window or the buffer layer is greater than that of the detection window material B.

TABLE 1

| | Maximum tensile strength of elastic deformation |
|---|---|
| Conventional comparative embodiment (detection window material A) | 62 kgf/cm$^2$ |
| Conventional comparative embodiment (detection window material B) | 84 kgf/cm$^2$ |
| First Embodiment (detection window material A) | 90 kgf/cm$^2$ |
| First Embodiment (detection window material B) | 95 kgf/cm$^2$ |
| Second Embodiment (detection window material B/buffer layer material A) | 97 kgf/cm$^2$ |

In the embodiments of the invention, only one detection window is utilized for illustration. However, a polishing pad having a plurality of detection windows can also be formed by using the same method. Furthermore, the polishing pad of the invention can be applied for polishing surfaces of objects in the manufacture of industrial devices. These objects include semiconductor wafers, III-V group wafers, storage device carriers, ceramic substrates, polymer substrates, glass substrates and so on. Nevertheless, the scope of the invention is not limited thereto.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A method of manufacturing a polishing pad having a detection window, the method comprising:

pre-disposing a dummy detection window in a mold;

filling a polishing layer precursor into the mold and performing a solidifying process to form a polishing layer, wherein the dummy detection window and the polishing layer are in direct contact and are separable completely;

separating the dummy detection window and the polishing layer to form a detection opening in the polishing layer wherein a surface energy difference between the dummy detection window and the polishing layer is greater than 10 mN/m; and filling a detection window precursor into the detection opening and performing a solidifying process to form a detection window.

2. The method of manufacturing the polishing pad as claimed in claim 1, wherein a material of the polishing layer is a polar material and a material of the dummy detection window is a non-polar material or a weak polar material.

3. The method of manufacturing the polishing pad as claimed in claim 2, wherein a material of the dummy detection window comprises fluoropolymer, polysiloxane, high density polyethylene, low density polyethylene, or polypropylene.

4. The method of manufacturing the polishing pad as claimed in claim 1, wherein the dummy detection window is opaque and comprises black, red, blue, or other dark colors.

5. The method of manufacturing the polishing pad as claimed in claim 1, wherein a material of the polishing layer comprises polyester, polyether, polyurethane, polycarbonate, polyacrylate, polybutadiene, epoxy resin, unsaturated polyester, or ethylene-vinyl acetate copolymer.

6. The method of manufacturing the polishing pad as claimed in claim 1, wherein a material of the detection window enables a light with a wavelength ranging from 600 nm to 700 nm to have a transmittance of at least 50%.

7. The method of manufacturing the polishing pad as claimed in claim 1, wherein a material of the detection window enables a light with a wavelength ranging from 400 nm to 700 nm to have a transmittance of at least 50%.

8. The method of manufacturing the polishing pad as claimed in claim 1, wherein the detection opening is a through opening or a blind opening.

* * * * *